US009045273B2

(12) United States Patent
Guo et al.

(10) Patent No.: US 9,045,273 B2
(45) Date of Patent: Jun. 2, 2015

(54) DISPLAY PANEL PACKAGING STRUCTURE

(71) Applicants: Beijing BOE Display Technology Co., LTD., Beijing (CN); BOE Technology Group Co., LTD., Beijing (CN)

(72) Inventors: Junjie Guo, Beijing (CN); Xibin Shao, Beijing (CN); Dan Wang, Beijing (CN); Bin Zou, Beijing (CN); Kai Diao, Beijing (CN); Haijun Shi, Beijing (CN)

(73) Assignees: BOE Technology Group Co., Ltd., Beijing (CN); Beijing BOE Disply Technology Co., Ltd., Beijing (CN)

( * ) Notice: Subject to any disclaimer, the term of this patent is extended or adjusted under 35 U.S.C. 154(b) by 0 days.

(21) Appl. No.: 14/164,629

(22) Filed: Jan. 27, 2014

(65) Prior Publication Data

US 2014/0262927 A1 Sep. 18, 2014

(30) Foreign Application Priority Data

Mar. 14, 2013 (CN) ..... 2013 2 0114743

(51) Int. Cl.
*B65D 85/30* (2006.01)
*B65D 81/05* (2006.01)

(52) U.S. Cl.
CPC ..... *B65D 81/056* (2013.01)

(58) Field of Classification Search
CPC .... B65D 85/30; B65D 85/48; B65D 2581/05; B65D 2581/051; H01L 21/67369
USPC ..... 206/706, 723, 453, 454, 455, 523, 449, 206/451
See application file for complete search history.

(56) References Cited

U.S. PATENT DOCUMENTS

| | | | | |
|---|---|---|---|---|
| 3,404,826 | A * | 10/1968 | Carmody | 206/523 |
| 3,701,465 | A * | 10/1972 | Richter | 206/521 |
| 6,666,334 | B2 * | 12/2003 | Fujii | 206/586 |
| 7,604,125 | B2 * | 10/2009 | Cheng et al. | 206/586 |
| 7,946,426 | B2 * | 5/2011 | Ohsawa et al. | 206/586 |
| 8,777,007 | B2 * | 7/2014 | Chen et al. | 206/454 |
| 2008/0128310 | A1 * | 6/2008 | Kao et al. | 206/521 |
| 2013/0270139 | A1 * | 10/2013 | Chen et al. | 206/453 |
| 2013/0293803 | A1 * | 11/2013 | Chen et al. | 349/58 |
| 2013/0306514 | A1 * | 11/2013 | Hu et al. | 206/586 |
| 2014/0069834 | A1 * | 3/2014 | Kuo et al. | 206/454 |
| 2014/0069835 | A1 * | 3/2014 | Kuo et al. | 206/454 |
| 2014/0138272 | A1 * | 5/2014 | Kuo et al. | 206/454 |

FOREIGN PATENT DOCUMENTS

CN 201128567 Y * 10/2008

OTHER PUBLICATIONS

CN 201128567—English translation.*

* cited by examiner

*Primary Examiner* — Steven A. Reynolds
(74) *Attorney, Agent, or Firm* — Westman, Champlin & Koehler, P.A.

(57) ABSTRACT

A display panel packaging structure is provided to avoid damage of the display panel during transportation. The display panel packaging structure includes a box and a cover covering the box. The box is adapted to receive a display panel and the box is provided with at least a stopper therein adapted to abut against a side surface of the display panel.

12 Claims, 3 Drawing Sheets

DISPLAY PANEL PACKAGING STRUCTURE

CROSS-REFERENCE TO RELATED APPLICATION

This application claims the benefit of Chinese Patent Application No. 201320114743.2 filed on Mar. 14, 2013 in the State Intellectual Property Office of China, the whole disclosure of which is incorporated herein by reference.

BACKGROUND OF THE INVENTION

1. Field of the Invention

The present invention relates to a technical field of packaging structure, and more particularly, to a display panel packaging structure.

2. Description of the Related Art

A packaging structure for a display packaging is typically a case consisting of a box and a cover. A display panel is disposed in the cavity of the box and then the cover is covered on the box so as to protect the display panel from damaging during the transportation. Most of the packaging structures are made of foam material directly, such as EPO (polystyrene-polyethylene mixed plastic foam), EPP (Expanded Polypropylene), EPS (Expanded Polystyrene). EPS is cheap, EPP is more expensive, and EPO is the most expensive.

FIG. 1 is a schematic view showing a display panel packaging structure in the art without showing a cover. In terms of manufacturing cost, the packaging structure for display panel 4' is typically made of EPS. However, because the size of a box 1' made of EPS is difficult to be accurately determined during manufacturing, the size of an internal cavity of the box 1' may be slightly larger than that of the display panel 4' such that the fixing and positioning capability of the box 1' with respect to the display 4' is poor, and during the transportation of the display panel, a large relative impact displacement will occur between an array substrate and a circuit board 5' of the display panel 4' and thus there is a possibility that the COF (Chip on Film) will break and the display panel is damaged.

SUMMARY OF THE INVENTION

In order to avoid the damage of the display panel during the transportation thereof, the embodiments of the present invention provide a display panel packaging structure.

To achieve the above object, the embodiments of the present invention provide solutions as below:

According to an exemplary embodiment of the present invention, a display panel packaging structure is provided, comprising a box defining a generally rectangular receiving space adapted to receive a display panel; and a cover covering the box, wherein the box is provided with at least one stopper therein adapted to abut against a side surface of the display panel received in the box.

Alternatively, the stopper is disposed at a corner inside the box; the stopper comprises a first insert part and a second insert part connected with each other and perpendicular to each other, wherein the first insert part is provided with a first boss parallel with the second insert part, and the second insert part is provided with a second boss parallel with the first insert part, the first boss and the second boss having stopping surfaces adapted to abut against different side surfaces of the display panel respectively; a groove is formed at a corner of the box for receiving the stopper, the groove comprising a first groove for receiving the first insert part and a second groove for receiving the second insert part, and the first groove having a first opening formed in its side wall through which the first boss extends into the receiving space, and the second groove having a second opening formed in its side wall through which the second boss extends into the receiving space.

Further alternatively, the stopper is provided with a strengthening plate at a side thereof in contact with a bottom surface of the box, the strengthening plate being integrally formed with the stopper; and the first opening and the second opening are connected with each other to form a notch for receiving the strengthening plate.

BRIEF DESCRIPTION OF THE DRAWINGS

In order to clearly explain the solutions described in the embodiments of the present invention or in the prior art, the figures used in the embodiments of the present invention or in the prior art will be briefly described in the following. Apparently, the figures described in the following are only exemplary embodiments of the invention and for a person skilled in the art, other figures can be conceived according to these figures.

LIST OF REFERENCE NUMERALS

Figure 1:
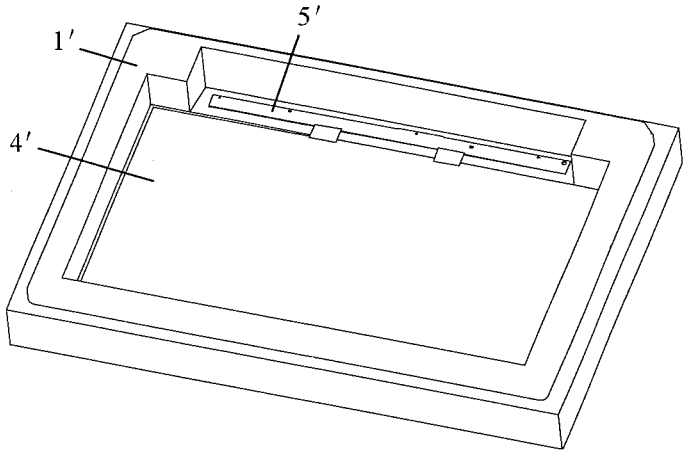
Fig. 1 (Prior Art)
FIG. 1 is a schematic view showing a display panel packaging structure in the prior art.

1—box, 10—first groove, 11—second groove, 12—groove, 13—notch, 14—insertion hole; 2—stopper, 20—first insert part, 21—second insert part, 22—first boss, 220—stopping surface of the first boss, 23—second boss, 230—stopping surface of the second boss, 24—strengthening plate, 240—supporting surface, 3—positioning rod, 4—display panel, 5—circuit board

DETAILED DESCRIPTION OF PREFERRED EMBODIMENTS OF THE INVENTION

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

Figure 2:
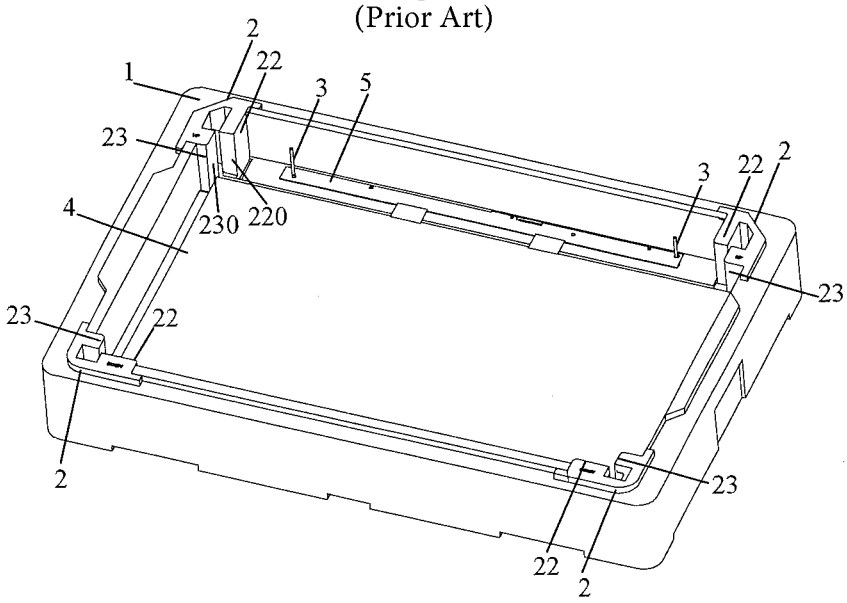
FIG. 2 is a schematic view showing a display panel packaging structure in which a display panel is fixed inside a box according to an exemplary embodiment of the present invention.

FIG. 2 is a schematic view of a display panel packaging structure in which a display panel is fixed according to an embodiment of the present invention. Referring to FIG. 2, the present invention provides a display panel packaging structure, comprising a box 1 defining a generally rectangular receiving space adapted to receive a display panel 4; and a cover (not shown in the figure) covering the box 1. The box 1 is provided with at least one stopper 2 therein adapted to abut against a side surface of the display panel 4.

In this way, when the size of the cavity of the box 1 is slightly larger than that of the display panel 4, because the side surfaces of the display panel 4 abut against the at least onestopper 2, the at least onestopper 2 can fix the display panel 4 firmly in the cavity of the box 1, such that during the transportation of the display panel, the break of the COF on the circuit board and thus the damage of the display panel due to relative impact displacement between the array substrate and the circuit board of the display panel are effectively prevented.

In order for a person skilled in the art to understand and implement the present invention better, a display panel packaging structure which will fixedly position the display panel according to an embodiment of the present invention will be described in detail in the following. It should be appreciated that the present invention can also be applied to fix other devices or components except for the display panel.

FIG. 2 is a schematic view showing a display panel packaging structure according to an embodiment of the present invention. The display panel packaging structure comprises a box 1, and a cover covering the box 1. The box 1 has an internal cavity adapted to receive a display panel 4. The box 1 is provided with at least one stopper 2 inside it. The stopper 2 is adapted to abut against a side surface of the display panel 4 such that the display panel 4 is firmly fixed in the cavity (receiving space) of the box 1 so as to improve the fixing and positioning capability of the box 1 with respect to the display panel 4. The box 1 may be made of EPS (polystyrene foam) having low cost. Although the cost of EPP or EPO is relatively high, EPP or EPO can meet the requirement for protecting the display panel, and therefore the material of the stopper 2 may be EPP or EPO, or the material of the stopper 2 may be PC (polycarbonate). Therefore, compared to that the whole box (including the stopper) is made of EPP or EPO, the cost for manufacturing the packaging structure can be reduced.

The stopper 2 may be disposed on a side wall of the cavity of the box 1, or it may be disposed at a corner between two adjacent side walls. Because the corner of the display panel is relatively sharp and the display panel and the box would easily impact with each other at the corner during the transportation and foam debris will be generated easily at the corner such that the cleanliness of the display panel cannot be controlled easily; however, when the stopper 2 is disposed at the corner, the above adverse situation can be avoided. Therefore, the solution of the present invention will be described with reference to a preferred embodiment in which the stopper 2 is disposed at the corner of the box 1.

According to the above embodiment, in order to prevent the four corners of the display panel 4 from contacting with the inner walls of the box 1, as a further preferred embodiment, referring to FIG. 2, a stopper 2 may be provided at each of the four corners of the box 1 so as to prevent the four corners of the display panel 4 from contacting with the inner walls of the box 1. Of course, the stoppers 2 may not be disposed at four corners as described above, instead, two stoppers 2 may be disposed respectively at two opposite corners in the cavity of the box 1, or three stoppers 2 may be disposed respectively at three corners in the cavity of the box 1.

The stopper 2 may be connected to the box 1 in many ways, such as adhesion, insertion and the like. Compared to adhesion, insertion is more stable and more difficult to drop-off, and thus can provide high impact resistance for the box, and therefore, the stopper 2 is preferably disposed in the box 1 by inserting.

Figure 3:
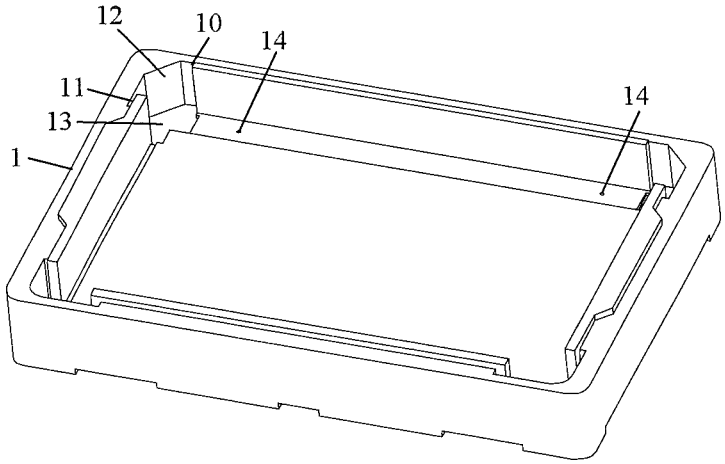
FIG. 3 is a schematic view showing a display panel packaging structure according to an exemplary embodiment of the present invention.
Figure 4:
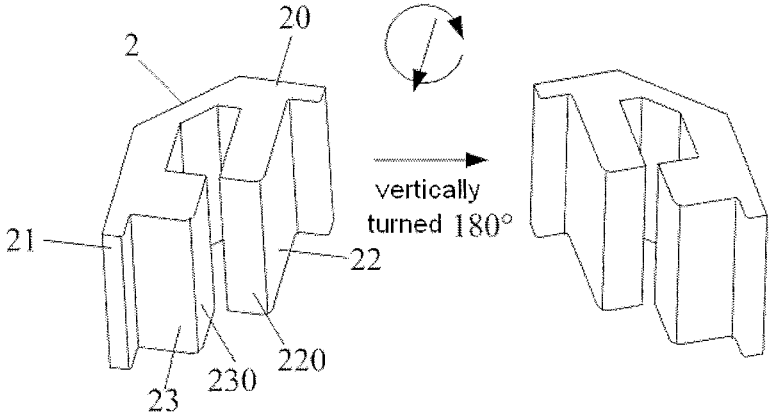
FIG. 4 is a schematic view showing a first structure of the stoppers disposed at an upper left corner and an upper right corner of the box.
Figure 5:
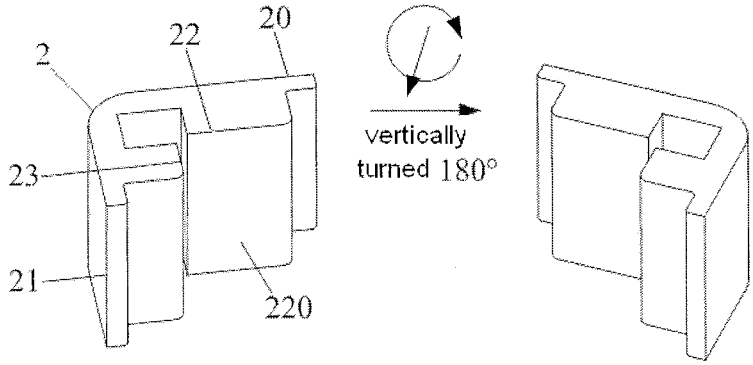
FIG. 5 is a schematic view showing a first structure of the stoppers disposed at a lower left corner and a lower right corner of the box.

As shown in FIG. 3 to FIG. 5, a first structure of the stopper 2 comprises a first insert part 20 and a second insert part 21 connected with each other. The first insert part 20 and the second insert part 21 may be perpendicular to or oblique with each other. The description of the present invention will be made to the example in which the first insert part 20 and the second insert part 21 are perpendicular to each other. The first insert part 20 is provided with a first boss 22 parallel with the second insert part 21, and the second insert part 21 is provided with a second boss 23 parallel with the first insert part 20. Correspondingly, a groove 12 is formed at a corner of the box 1 for receiving the stopper 2. The groove 12 comprises a first groove 10 for receiving the first insert part 20 and a second groove 11 for receiving the second insert part 21. The first groove 10 has a first opening (not shown in the figure) formed in its side wall through which the first boss 22 extends into the cavity of the box, and the second groove 11 has a second opening (not shown in the figure) formed in its side wall through which the second boss 23 extends into the cavity of the box. The first opening and the second opening can be connected to each other to form a notch 13 shown in the FIG. 3. In this way, after the stopper 2 is inserted into the groove 12 in the box 1, the first boss 22 extends through the first opening and its stopping surface 220 abuts against a side surface of the display panel 4, and the second boss 23 extends through the second opening and its stopping surface 230 abuts against another side surface of the display panel 4. Therefore, four stoppers 2 may fix and position the display panel 4.

The shapes of the first boss 22 and the second boss 23 are not limited to those shown in the FIG. 3. Except for the surfaces in contact with the display panel 4 and the bottom surface of the box 1, other surfaces of the boss 22 and the boss 23 may be convex (spherical) arc surfaces or concave arc surfaces and the like. In addition, the first boss 22 and the second boss 23 may have the same height as that of the stopper 2 as shown in the figures. In this way, the process to manufacture the stopper may be simple. Of course, it is not limited to the structure as shown in the figures. The height of the first boss 22 and the second boss 23 may be different from that of the stopper.

Figure 6:
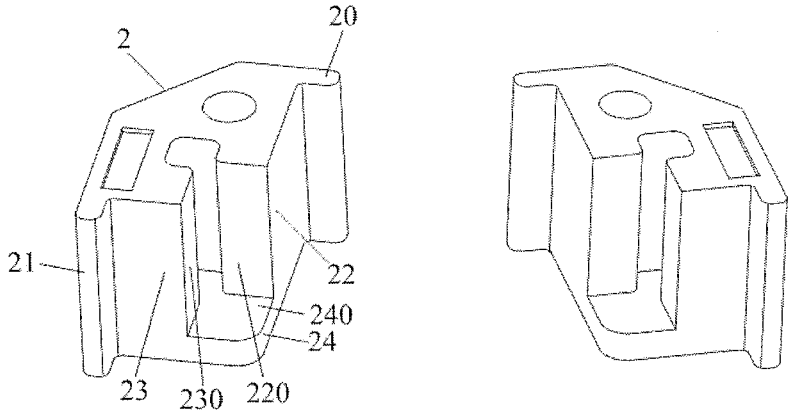
FIG. 6 is a schematic view showing a second structure of the stoppers disposed at an upper left corner and an upper right corner of the box.
Figure 7:
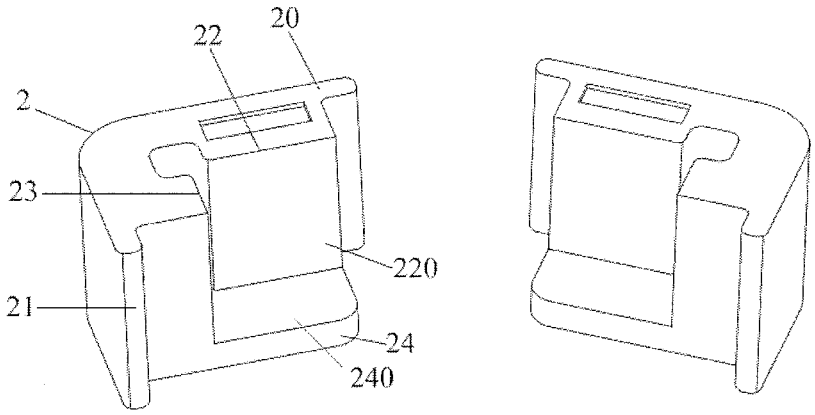
FIG. 7 is a schematic view showing a second structure of the stoppers disposed at a lower left corner and a lower right corner of the box.

As shown in FIGS. 6 and 7, in addition to the first structure as described above, a second structure of the stopper 2 further comprises a strengthening plate 24 on a side facing the bottom surface of the box 1. The strengthening plate 24 is formed integrally with the stopper 2. Correspondingly, the first opening and the second opening of the box 1 may be connected with each to form a notch 13 as shown in FIG. 3 for receiving the strengthening plate 24. Since the stopper structure without the strengthening plate 24 is easy to break at the middle portion (the portion between the first boss 22 and the second boss 23 shown in FIG. 4 or 5) of the stopper 2, the strengthening plate 24 is provided to improve the strength of the stopper 2.

The strengthening plate 24 has a supporting surface 240 for supporting the display panel 4 such that there is a gap between the display panel 4 and the bottom surface of the cavity of the box 1. The thickness of the gap is the thickness of the strengthening plate 24. That is, the supporting surface 240 and the bottom surface of the cavity of the box 1 are not in the same level. Because the height of the cavity of the box 1 is limited, the thickness of the strengthening plate 24 should be designed to ensure that the display panel 4 supported by it is always disposed inside the cavity of the box 1.

Please note that the four stoppers 2 disposed in the box 1 may be the first structure or the second structure of the same size. However, according to actual situation, because a circuit board 5 is connected above the display panel 4, in a state as shown in FIG. 2, the structures of the stoppers at the upper corners are different from the structures of the stoppers at the lower corners in size. Specifically, the first bosses 22 of the stoppers 2 at the upper left corner and the upper right corner extend to the cavity by a length larger than a length by which the lower left corner and the lower right corner extend to the cavity. In this way, when the stopper 2 at the upper left corner has the first structure, referring to FIG. 4 or FIG. 5, it may be disposed at the upper right corner after being turned vertically around an axis as shown in FIG. 4 or 5 by 180 degree. That is, the two stoppers at the upper corners may be exchanged with each other. In addition, when the stopper 2 at the lower left corner itself has a symmetrical structure, the stopper 2 may be disposed at the lower right corner after being turned horizontally or vertically by 180 degree. That is, the two stoppers at the lower corners may be exchanged with each other. On the other hand, when the stopper 2 at the lower left corner itself has an asymmetrical structure, the stopper 2 may not be disposed at the lower right corner after being turned vertically by 180 degree. That is, the two stoppers at the lower corners may not be exchanged with each other.

Referring again to FIG. 6 or 7, when the stopper 2 has the second structure, the stopper 2 at the upper left corner may not be disposed at the upper right corner after being turned vertically or horizontally by 180 degree. That is, the two stoppers at the upper corners may not be exchanged with each other. In addition, when the stopper 2 at the lower left corner itself has a symmetrical structure, the stopper 2 may be disposed at the lower right corner after being turned horizontally by 180 degree. That is, the two stoppers at the lower corners may be exchanged with each other. On the other hand, when the stopper 2 at the lower left corner has an asymmetrical structure itself, the stopper 2 may not be disposed at the lower right corner after being turned horizontally or vertically by 180 degree. That is, the two stoppers at the lower corners may not be exchanged with each other.

The structure of the stopper at the upper corners and the structure of the stopper at the lower corners of the cavity of the box 1 are not limited to any of the above combinations. For example, according to the embodiment shown in FIGS. 4 and 5, the two stoppers at the upper corners are exchangeable, and the two stoppers at the lower corners are exchangeable. Or according to the embodiment shown in FIGS. 6 and 7, the two stoppers at the upper corners are not exchangeable, and the two stoppers at the lower corners are not exchangeable. The structure of the stoppers can be determined according to actual requirements.

Referring to FIGS. 2 and 3 again, the display panel packaging structure of the embodiment of the present invention further comprises a positioning rod 3. The positioning rod 3 serves to fix the circuit board 5 of the display panel 4 to prevent the circuit board from displacing during the transportation so that the COF may not break after repeatedly pulling due to large displacement.

Though not shown in FIG. 3, the circuit board 5 is provided with through holes for receiving the positioning rod 3. The box 1 is provided with insertion holes at positions corresponding to the through holes for receiving the positioning rod 3. After the display panel 4 is fixed inside the cavity of the box 1, the positioning rod 3 passes though the through hole in the circuit board 5 and is inserted into the insertion hole in the bottom of the box 1, so as to realize the fixation of the board 5 by the positioning rod 3. Of course, the structure for fixing the display panel 4 and the circuit board 5 is not limited to the structure of the positioning rod 3. For example, the structure similar to the above stoppers may be used and thus the fixation of the circuit board may be realized by abutting the stoppers against the circuit board.

The positioning rod 3 may be made of iron, stainless steel or other metal material or alloy material such as aluminum alloy, or engineering plastic such as PC.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. A display panel packaging structure, comprising:

a box defining a generally rectangular receiving space adapted to receive a display panel wherein the box is provided therein with at least one stopper adapted to abut against a side surface of the display panel received in the box;

the stopper is disposed inside the box by inserting at a corner of the box;

the stopper comprises a first insert part and a second insert part connected with each other and perpendicular to each other, wherein the first insert part is provided with a first boss parallel with the second insert part, and the second insert part is provided with a second boss parallel with the first insert part, the first boss and the second boss having stopping surfaces adapted to abut against different side surfaces of the display panel respectively, and wherein the first insert part comprises a first edge portion extending beyond the first boss, and the second insert part comprises a second edge portion extending beyond the second boss;

a groove is formed at a corner of the box for receiving the stopper, the groove comprising a first groove for receiving the first insert part and a second groove for receiving the second insert part, and the first groove having a first opening formed in its first side wall through which the first boss extends into the receiving space, and the second groove having a second opening formed in its second side wall through which the second boss extends into the receiving space, wherein the first groove comprises a first locating groove, the second groove comprises a second locating groove, the first side wall is located between the first locating groove and the receiving space, the second side wall is located between the second locating groove and the receiving space, and the first edge portion and the second edge portion are provided in the first locating groove and the second locating groove respectively.

2. The display panel packaging structure according to claim 1, wherein the stopper is disposed at a corner inside the box.

3. The display panel packaging structure according to claim 2, wherein four stoppers are disposed respectively at four corners inside the box.

4. The display panel packaging structure according to claim 1, wherein the stopper is disposed inside the box by inserting or adhering.

5. The display panel packaging structure according to claim 1, wherein the stopper is provided at a side thereof with a strengthening plate in contact with a bottom surface of the box, the strengthening plate being integrally formed with the stopper; and the first opening and the second opening are connected with each other to form a notch for receiving the strengthening plate.

6. The display panel packaging structure according to claim 5, wherein the strengthening plate has a supporting surface adapted to support the display panel.

7. The display panel packaging structure according to claim 1, wherein display panel packaging structure comprises four stoppers disposed at four corners of the box respectively.

8. The display panel packaging structure according to claim 7, wherein the four stoppers are divided into two pairs, and one stopper of at least one pair corresponds to the other stopper of the pair after being turned vertically by 180 degree.

9. The display panel packaging structure according to claim 1, further comprising a positioning rod adapted to fix a circuit board of the display panel.

10. The display panel packaging structure according to claim 9, wherein a through hole is formed in the circuit board for receiving the positioning rod, and an insertion hole is formed in the box at a position corresponding to the through hole for receiving the positioning rod.

11. The display panel packaging structure according to claim 1, wherein the box is made of polystyrene foam, and the stopper is made of polypropylene plastic foam, polystyrene foam or polycarbonate.

12. The display panel packaging structure according to claim 9, wherein the positioning rod is made of metal or plastic material.

* * * * *